United States Patent [19]

Hoagland

[11] 4,274,628

[45] Jun. 23, 1981

[54] WEIGHT LIFTING BAR APPARATUS

[76] Inventor: Jesse Hoagland, 333 Bellevue Ave., Trenton, N.J. 08618

[21] Appl. No.: 75,281

[22] Filed: Sep. 12, 1979

[51] Int. Cl.[3] ..... A63B 13/00

[52] U.S. Cl. ..... 272/123

[58] Field of Search ..... 272/119, 116, 123, 143, 272/DIG.4, 117, 126; 224/265, 270, 266

[56] References Cited

U.S. PATENT DOCUMENTS

| | | | |
|---|---|---|---|
| 460,270 | 9/1891 | Somerby . | |
| 2,508,567 | 5/1950 | Dymeck . | |
| 2,722,419 | 11/1955 | Tarapczynski | 272/123 |
| 2,986,314 | 5/1961 | Miller | 224/266 |
| 3,468,534 | 9/1969 | Donato . | |
| 3,679,107 | 7/1972 | Perrine | 272/123 X |
| 3,820,781 | 6/1974 | Kane . | |

FOREIGN PATENT DOCUMENTS

| | | | |
|---|---|---|---|
| 223796 | 12/1968 | Sweden | 224/266 |

*Primary Examiner*—William R. Browne

*Attorney, Agent, or Firm*—John J. Kane; Frederick A. Zoda; Albert Sperry

[57] ABSTRACT

A weight lifting bar apparatus particularly usable for leg exercises such as deep knee bends and toe lifts which includes a support bar extending laterally and adapted to be placed generally upon the shoulders of the user and a weight retaining bar extending out of each end of the support bar but axially displaced downwardly therefrom. The weight retaining bar is adapted to receive the weight secured thereto by standardly configured collars. The apparatus further including projecting support members extending downwardly and projecting forwardly from the support bar in order to rest upon the shoulders of the user and facilitate retaining of the apparatus during exercising upon his shoulders. The projecting support members are preferably at an axial angle of approximately 28° with respect to the axis of the displaced weight retaining bar, in this manner, the weight will rest upon the shoulders and back of the user without requiring holding of the bar by his hands. The projecting support members will be pressed against the chest of a user due to the influence of the weights on the weight retaining bars.

11 Claims, 4 Drawing Figures

Fig. 1.
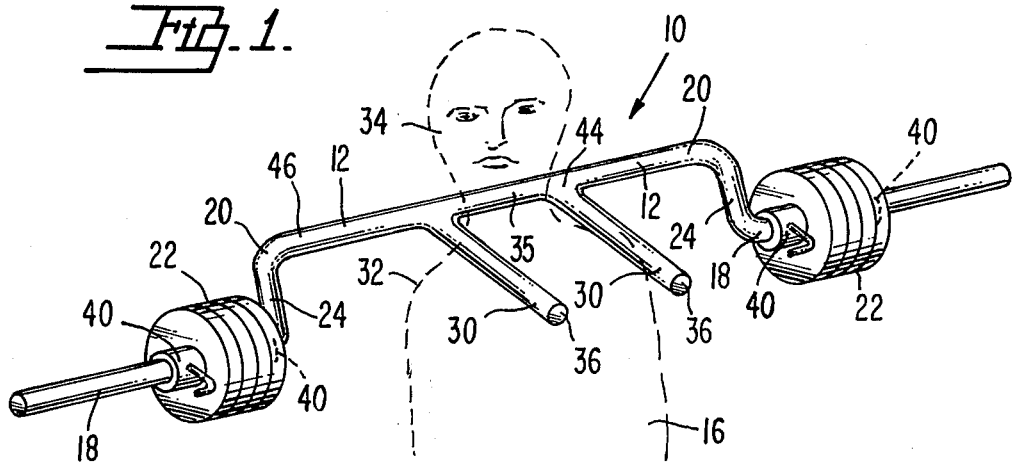
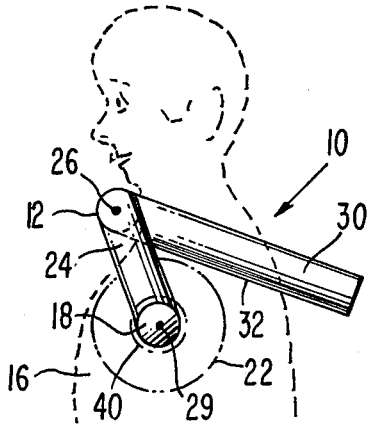
Fig. 3.
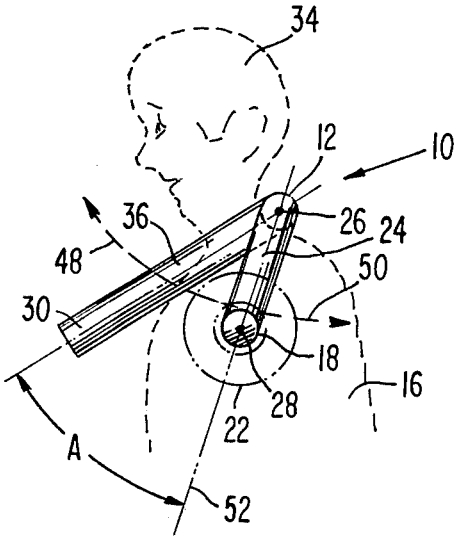
Fig. 2.
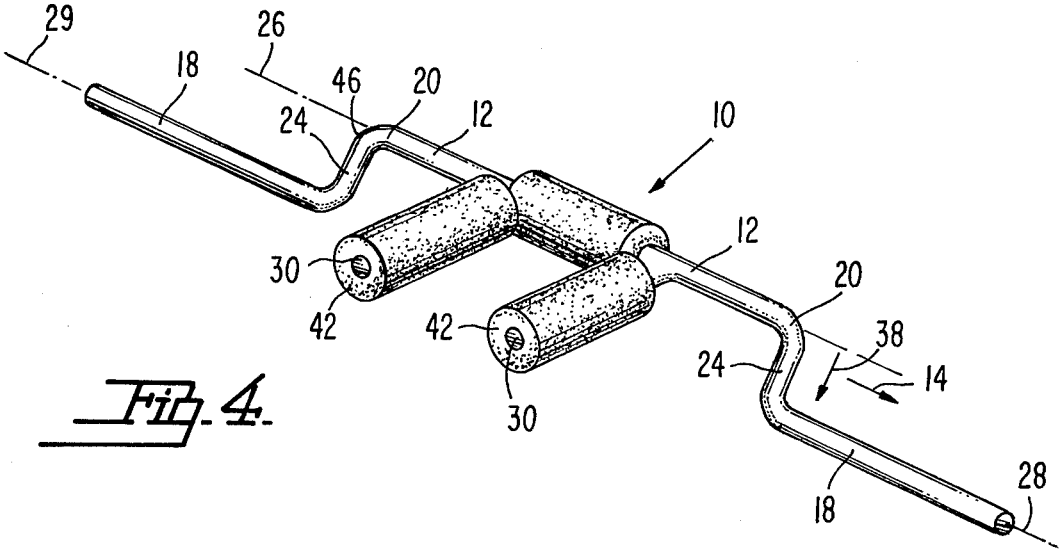
Fig. 4.

WEIGHT LIFTING BAR APPARATUS

BACKGROUND OF THE INVENTION

1. Field of the Invention

The present invention applies to the field of weight lifting apparatus and specifically to those such devices usable when performing leg exercises such as deep knee bends and toe lifts.

2. Description of the Prior Art

The present procedure for performing leg exercises with weight lifting apparatus is for the user to lift the weight above his head and then allow the weights to gently settle upon the back of his neck. The user will then retain the weight in this position by holding the bar with his hands and pushing upwardly and gently forwardly against the back of his neck. In this manner the weights will be held in place and be relatively secure during the chosen exercise. Alternatively, the weights may be placed upon the user's back by assisting personnel or may be lifted from a weight rack.

The problem with such primitive exercising procedures has been to undue strain created upon the spine of the user and the undue tension created in the arms during a completely leg related exercise. To overcome this difficulty, some devices have been utilized such as those found in U.S. Pat. Nos. 3,820,781; 3,679,107; 3,468,534; 2,722,419; 2,508,567; and 460,270. Of particular pertinence is U.S. Pat. No. 3,679,107 on a lifting yoke to Walter F. Perrine. This invention discloses a weight lifting yoke which is strapped to the shoulders of the wearer by belts which extend in a crossing pattern over the chest and back of the wearer. A weight lifting bar retaining means is secured to this yoke to alleviate some of the stress of the weights upon the back. The present design is distinguishable from this design in that no such buckles or belts or securing means are required and the present device is easily put in place merely by lifting of the weights in a single fashion either from the floor or from a weight rack.

SUMMARY OF THE INVENTION

The present invention provides a weight lifting apparatus particularly usable for performing leg exercises such as deep knee bends and toe lifts. The apparatus itself includes a support bar which extends laterally and is adapted to be gripped by the hands of the user for lifting into place upon his shoulders. Once in place the support bar means provides some element of support for holding the weights upon the neck and shoulders of the user. However, with the present invention the amount of weight placed upon the neck of the user and the spine of the user is minimized.

At each outer end of the support bar is located a displacement coupling. This displacement coupling interconnects the support bar with a weight retaining bar. One weight retaining bar extends out of each displacement means located on each end of the support bar. The weight retaining means actually extends outwardly from the support bar and is adapted to hold the weights of the weight lifting apparatus thereon. The displacement coupling provides a means of interconnection between the weight retaining bar means and the support bar. The displacement coupling secures these two bar means with respect to one another in such a fashion that the axes thereof are displaced and yet still parallel with respect to one another. The actual configuration preferably includes the weight retaining bar means being displaced downwardly and parallel to the laterally extending direction of the support bar means.

To facilitate the holding of the support bar securely and gently upon the shoulders of the user a projecting support means is included which is secured to the support bar means and extends downwardly and projects forwardly therefrom. In this manner the projecting support means is adapted to rest upon the shoulders of the user to facilitate the retaining of the weight lifting apparatus by the user and more evenly distribute the weight upon the shoulders.

There is a preferred angular orientation between the projecting support means and the weight retaining bar means. That is, each of these two devices projects at an angle from the axis of the support bar means. With the support bar means and the weight retaining bar means arranged in a vertical orientation with the weight retaining bar means extending directly vertically downward therefrom, the projecting support means will extend downwardly with a forward positional component such that the angle between the projecting support means and the weight retaining bar means will be approximately 28° or in a range of 10° to 45° . In this manner when the apparatus of the present invention is placed upon the shoulders of the user a slight rotation of the bar will occur since the persons chest will press against the undersurface of the projecting support means. In this manner the weight retaining bar means will be moved somewhat such that it is not directly vertically below the support bar means. The resting position of the apparatus of the present invention is with the weight retaining bar means directly vertically below the support bar means. This is especially evident when substantial weight is placed upon the weight retaining bar means. Therefore, the tendency of the weight retaining bar means to push downwardly counterbalanced by the force of the persons's chest exerted upwardly against projecting support means will cause the bar to be retained in place upon the users shoulders in a secure manner. The preferable angular orientation of 28° between the weight retaining bar means and the projecting support means is desirable in order to properly counterbalance the upwardly exerted force by the person's chest and the downwardly exerted tangential force of the weights.

The projecting support means preferably consists of two downwardly and forwardly projecting support members which are adapted to receive the users head positioned therebetween during exercising. The invention may further include the weight means themselves which are adapted to be secured upon the weight retaining bar means and a collar means which is adapted to retain the weights in place thereon.

Further alternatively the present invention may include a cushioning means which is selectively securable to the support bar means and the projecting support means to thereby facilitate comfort of usage during exercise. The projecting support means themselves may be welded to the support bar means and the support bar means, the displacement coupling means and the weight retaining means preferably will together form a single integral bar.

It is an object of the present invention to provide a weight lifting bar apparatus which is particularly adaptable for use in performing leg exercises such as deep knee bends and toe lifts.

It is an object of the present invention to provide a weight lifting bar apparatus which minimizes the force exerted downwardly upon the spine of the user.

It is an object of the present invention to provide a weight lifting bar apparatus which more evenly distributes the pressure of the weight over the shoulders and chest of the user.

It is an object of the present invention to provide a weight lifting bar apparatus which does not require the user to hold the bar during exercising.

It is an object of the present invention to provide a weight lifting bar apparatus which is usable by persons with one arm or no arms when doing leg exercises such as deep knee bends or toe lifts.

It is an object of the present invention to provide a weight lifting bar apparatus which eliminates any damage to the fingers and hands of the user.

It is an object of the present invention to provide a weight lifting bar apparatus which balances itself automatically and does not require the user to constantly adjust the forward and rearward position to maintain equilibrium upon the user's shoulders.

It is an object of the present invention to provide a weight lifting bar apparatus which prevents rolling of the bar off the back of the user's shoulders.

It is an object of the present invention to provide a weight lifting bar apparatus which is usable to hold the weight lifting bar in the front of the user's neck without requiring the bar to be grasped by the user during exercising.

It is an object of the present invention to provide a weight lifting bar apparatus which more accurately allows the user to keep his back straight.

It is an object of the present invention to provide a weight lifting bar apparatus which allows the user to keep his hands free and thereby possibly push upward if the weight is found to be too heavy or the repetitions of the exercise found to be too many.

It is an object of the present invention to provide a weight lifting bar apparatus which is safer in usage when performing leg exercises.

It is an object of the present invention to provide a weight lifting bar apparatus which increases the amount of weight that a user can exercise with when doing leg exercises.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective view of an embodiment of the weight lifting bar apparatus of the present invention showing the apparatus in place upon the shoulders of the user;

FIG. 2 is a side cross-sectional view of the embodiment of the present invention shown in FIG. 1;

FIG. 3 is a side cross-sectional view of an embodiment of the weight lifting bar apparatus of the present invention shown in the reverse position with the projecting support members extending across the back of the user; and FIG. 4 is a perspective view of an embodiment of the weight lifting bar apparatus of the present invention showing the cushioning means 42 in place.

DETAILED DESCRIPTION OF THE PREFERRED EMBODIMENT

The present invention provides a weight lifting bar apparatus 10 which includes a support bar means 12 extending in the lateral direction 14. This support bar means 12 is the conventional portion of the weight lifting bar which is adapted to be gripped by the user 16 when performing exercises.

The present invention further includes a weight retaining bar means 18 extending outwardly from the ends 20 of the support bar means 12. The weight means 22 are adapted to be secured to the weight retaining bar means 18 for controllable variation in the weight of the apparatus 10 during given exercises. Each of the weight retaining bar means 18 are secured to the support bar means 12 by a displacement coupling means 24. It is the purpose of the displacement coupling means to control the orientation between the weight retaining bar means 18 and the support bar means 12. It is desirable that the axis 26 of the support bar be parallel to but displaced from the axis 28 and 29 of the weight retaining bar means 18.

A projecting support means 30 is preferably fixedly secured to the support bar means 12 in such a manner to be extending downwardly and projecting forwardly therefrom. In this manner when the weight lifting bar apparatus 10 is being utilized, the projecting support means 30 will rest upon the shoulders of the user to facilitate the retaining of the apparatus during exercise. In this manner the weight of the apparatus will be more evenly distributed upon the shoulders and chest and downward through the leg muscles rather than being concentrated on the spine as with previous designs. It is preferable that the projecting support means comprises two projecting support members 36 which are adapted to extend over the shoulder 32 of the user on either side of his head 34 and neck 35 by extending in the forward direction 38.

When the weight means 22 are secured upon the weight retaining bar means 18 it is preferable to include a collar means 40 to facilitate this actual securement. Also, to facilitate comfort during exercising a cushioning means 42 may be configured positioned about the support bar means 12 and about the projecting support means 30. This cushioning will also help in evenly distributing the downward force of the weight upon the shoulders of the user.

Although it is not required, usually a weld 44 will be the means of fixed securement between the two projecting support members 36 and the support bar means 12. Also, it is not absolutely required but is preferable to form the support bar means 12, the displacement coupling means 24 and the weight retaining bar means 18 as a single integral bar 46.

The principle of operation of the present invention is based upon a combination of leverage created by the axial angle A between the weight retaining bar means 18 and the projecting support means 30. If the weight lifting bar apparatus of the present invention were supported loosely at the support bar means such that rotation was possible, and if a substantial amount of weights 22 were on the weight retaining bar means 18, then the bar would assume a steady state position wherein the bar means 18 is almost directly below the support bar means 12. With this orientation the projecting support members 36 would extend forwardly of the normal direction at an acute angle of approximately 28° or generally in the range of 10° to 45° . This steady state orientation is due to the substantial weight ratio between the actual weight of the two projecting support members 36 and the total weight of the weight means 22 upon the weight retaining bar means 18.

When the bar is actually placed upon the shoulders of the user as shown best in FIG. 2, the user's chest will exert an upwardly directed tangential force 48. This force is tangential to a circle about the axis 26 of the support bar. This upwardly directed force will cause a slight rotation of the bar in the clockwise direction as shown in FIG. 2. This slight clockwise rotation will cause the axis 52 extending between the weight retaining bar means 18 and the support bar means 12 to be rotated slightly clockwise off of the vertical direction. Then, since the bar has been so rotated and since the steady state condition exists when the axis 52 is almost in the vertical direction a downwardly exerted force will be created by the potential energy now stored within the weight means 22. This will result in a downward tangential force 50 in a counter-direction to the upward force 48. These two forces will be equal and opposite and will hold the weight lifting bar apparatus 10 of the present invention in a fixed orientation upon the shoulders 32 of the user 16. It must be appreciated that these forces will not be excessively great but will only be slight in comparison with the force required for holding these weights normally required with standard bar bell configurations. The actual amount of force is controllable by varying the axial angle A. With certain sized users having various configurations of the upper chest area and shoulders the angle may have to be made slightly smaller or slightly larger, but will generally fall within the 10°–45° range.

It should be appreciated that the present invention is also identically usable in the reverse orientation as shown in FIG. 3. In this orientation the support bar means 12 will be positioned in the front of the neck of the user and the high part of the back of the user will cause a slight counterclockwise rotation of the entire apparatus 10 which will result in a downward force exerted in a clockwise direction. The forces and pressures will be the same as in the description of the configuration in FIG. 2, however, the circumferential directions will be opposite. Sometimes it is helpful in the reverse orientation to give the bar a slight upward force for added stability. This can be most easily done by having the user cross his arms under the bar to provide a resting surface for the bar.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A weight lifting bar apparatus, particularly adapted for use in performing leg exercises such as deep knee bends and toe lifts, which comprises:

(a) a support bar means extending laterally and adapted to be supported by the user to hold the weight lifting apparatus;

(b) a weight retaining bar means spaced laterally outward from each end of said support bar means, said weight retaining bar means being adapted to hold the weight of the weight lifting apparatus thereon;

(c) a displacement coupling means interconnecting said weight retaining bar means with the ends of said support bar means in a displaced parallel orientation wherein the axis of said weight retaining bar means is displaced below and parallel with respect to the axis of said support bar means; and (d) a projecting support means secured to said support bar means and extending laterally therefrom and downwardly to rest upon the shoulders and chest of the user to facilitate retaining of the apparatus by the user and to more evenly distribute the weight thereof said support means pressing against the chest of a user under the influence of weights on the weight retaining bar means.

2. The apparatus as defined in claim 1 wherein said projecting support means extends forwardly from said support bar means at an axial angle of 10° to 45° with respect to said downwardly extending weight retaining bar means.

3. The apparatus as defined in claim 2 wherein the axial angle is approximately 28° .

4. The apparatus as defined in claim 1 wherein said projecting support means comprises two downwardly and forwardly projecting support members adapted to receive the user's head therebetween.

5. The apparatus as defined in claim 1 further comprising collar means to retain weights in place upon said weight retaining bar means.

6. The apparatus as defined in claim 1 further comprising weight means adapted to be secured on to said weight retaining bar means.

7. The apparatus as defined in claim 1 further comprising cushioning means selectively securable to said support bar means and said projecting support means to facilitate comfort of usage of the weight lifting bar apparatus.

8. The apparatus as defined in claim 1 wherein said projecting support means is welded to said support bar means.

9. The apparatus as defined in claim 1 wherein said support bar means, said displacement coupling means and said weight retaining bar means together are formed as a single integral bar.

10. The apparatus as defined in claim 1 wherein said weight retaining bar means extends outwardly from each end of said support bar means with each outwardly extending section being coaxial with respect to one another.

11. A weight lifting bar apparatus particularly adapted for use in performing leg exercises such as deep knee bends and toe lifts, which comprises:

(a) a support bar means extending laterally and adapted to be supported by the user to hold the weight lifting apparatus;

(b) a weight retaining bar means forming a single integral bar with said support bar means and spaced laterally outward from each end of said support bar means, said weight retaining means being adapted to hold the weight of the weight lifting apparatus thereon;

(c) a displacement coupling means forming a single integral bar with said weight retaining bar means and said support bar means and interconnecting each of said weight retaining bar means with the ends of said support bar means in a displaced parallel orientation wherein the axis of each of said weight retaining bar means is displaced below and parallel with respect to the axis of said support bar means; and (d) a projecting support means comprising two substantially parallel spaced apart laterally projecting support members adapted to receive the user's head therebetween when in use, said projecting support members being secured to said support bar means at one end of each said projecting support member and extending from the support bar means to a position forwardly of a user's chest and to facilitate retaining of the apparatus by the user and to more evenly distribute the weight thereof, said projecting support means and said weight retaining bar means forming an angle of 28° therebetween, said support means pressing against the chest of a user under the influence of weights on the weight retaining bar means.

* * * * *